US006302103B1

(12) United States Patent
Resnick

(10) Patent No.: US 6,302,103 B1
(45) Date of Patent: Oct. 16, 2001

(54) PROTECTIVE HOOD WITH INTEGRATED EXTERNALLY ADJUSTABLE NOSE CLIP

(76) Inventor: Todd A. Resnick, P.O. Box 1559, Stuart, FL (US) 34995

( * ) Notice: Subject to any disclaimer, the term of this patent is extended or adjusted under 35 U.S.C. 154(b) by 0 days.

(21) Appl. No.: 09/393,628

(22) Filed: Sep. 10, 1999

(51) Int. Cl.[7] ..... A62B 17/04

(52) U.S. Cl. ..... 128/201.23; 128/206.21; 128/206.28

(58) Field of Search ..... 128/201.12, 201.18, 128/201.22, 201.23, 205.25, 206.13, 206.17, 206.21, 206.28, 206.18, 207.13

(56) References Cited

U.S. PATENT DOCUMENTS

| | | | | |
|---|---|---|---|---|
| 1,978,994 | | 10/1934 | Fortunato . | |
| 2,015,617 | | 9/1935 | Claudis . | |
| 4,077,068 | | 3/1978 | Anderson . | |
| 4,164,218 | | 8/1979 | Martin . | |
| 4,231,359 | | 11/1980 | Martin . | |
| 4,294,243 | | 10/1981 | Ernsting et al. . | |
| 4,674,492 | * | 6/1987 | Niemeyer | 128/260.17 |
| 4,926,853 | | 5/1990 | Meunier . | |
| 5,186,165 | | 2/1993 | Swann . | |
| 5,357,947 | * | 10/1994 | Adler | 128/206.17 |
| 5,533,504 | | 7/1996 | Stamos . | |
| 5,572,989 | | 11/1996 | Lutz et al. . | |
| 5,575,277 | | 11/1996 | Lutz et al. . | |
| 5,957,131 | * | 9/1999 | Hutchinson et al. | 128/206.17 |

* cited by examiner

*Primary Examiner*—Glenn K. Dawson
(74) *Attorney, Agent, or Firm*—Anton J. Hopen; Smith & Hopen, P.A.

(57) ABSTRACT

A respiratory protective hood having an integrated, externally adjustable noseclip for occluding the nose to obstruct nasal respiration. An air-impermeable hood adapted to enclose the head of a wearer is provided. The hood has a nasal region, an ocular region and an oral region. A substantially transparent visor is sealingly integrated into the ocular region of the air-impermeable hood and adapted to permit outward vision by the wearer. A noseclip adapted to compress a wearer's nostrils together is provided thereby substantially inhibiting nasal respiration. An actuator for engaging and disengaging the noseclip from the wearer's nostrils is positioned external to a nasal access passage cut from the air-impermeable hood in the nasal region. An elastomeric air-impermeable boot securely fitted to the actuator means air-impermeably seals the nasal access passage whereby the wearer engages and disengages the noseclip to the wearer's nostrils by manipulation of the actuator.

10 Claims, 11 Drawing Sheets

PROTECTIVE HOOD WITH INTEGRATED EXTERNALLY ADJUSTABLE NOSE CLIP

FIELD OF INVENTION

The present invention relates generally to respiratory protective devices and more particularly to a protective hood with an integrated, externally adjustable noseclip.

BACKGROUND OF THE INVENTION

Respiratory protective hoods are well known in the prior art They typically comprise an air-inpermeable enclosure sealed at the wearer's neck and fitted with a substantially transparent visor and breathing respirator.

Some respiratory protective hoods use a half-mask (aka "nose cup") breathing interface. The half-mask seals around the wearer's nose and mouth area. However, a half-mask must be sized to accommodate the facial variations within a given population and a particular sized half-mask must be matched to the proper user. The inability of a hood with a half-mask to universally fit an adult population significantly complicates the logistics of protecting that same population. Another drawback of a hood with half-mask is the size and cost. These masks are difficult to store in a compact form. This hinders the portability and storage properties of the mask. Hoods with a half-mask utilize a significant amount of materials, thereby increasing their costs. Still another drawback to these designs is the pressure needed to keep the half-mask sealed to the face. Methods of applying pressure include placing tensioned straps around the head of the wearer. Properly adjusting these straps requires additional training and expends additional donning time in an emergency situation. Furthermore, the tension used to draw the mask to the face makes the design highly claustrophobic. The greater sealing area and the required tensioning system necessitate higher manufacturing costs, greater weight, greater bulk and more complexity in operation.

Many problems with the hood with half-mask are overcome by the use of a mouthpiece respirator. Mouthpiece respirators engaged by the wearer's mouth purify air drawn in through the oral pathway to the lungs by inhalation. The mouthpiece respirators also provide a pathway for exhalation. The mouthpiece respirator provides a number of distinct advantages over a hood with half-mask.

Mouthpiece respirators may be engaged and disengaged by the wearer while still wearing the protective hood. In addition, tension straps are not required when using the mouthpiece respirator as the support and seal to the air purifying means is provided by the wearer's mouth. This provides a marked level of control and comfort by the wearer. Conversely, the wearer of a hood with half-mask suffers from continual pressure as the mask is pulled up against the face by tension in the straps.

An advantage of using a mouthpiece over a hood with half-mask is that of size. Mouthpiece respirators engage the oral cavity of the user while a half-mask must cover a significant area of the face. Accordingly, mouthpiece respirators are smaller and more compact while a hood with half-mask is larger and more bulky. This size difference also contributes to a lower manufacturing cost, better portability and easier storage for the mouthpiece design.

Another advantage of the mouthpiece respirator over a hood with half-mask is that of simplicity and speed. A hood with half-mask must be securely sealed against the face with a sufficient amount of pressure. If the amount of force is too little, leakage may occur, thereby lowering or negating the protection factor of the device. If the amount of force is too high, then the mask becomes too uncomfortable to wear. Some hoods with a half-mask utilize manual straps to adjust the tension level while other designs automatically provide a predetermined level of tension. Requiring the wearer to adjust manual straps in order to properly fit the hood requires significant training and repeated practice in order to assure the wearer is able to don the hood properly in an emergency situation. However, regardless of proficiency and skill, each adjustment step requires time in which the user may be subject to hazardous or even deadly conditions.

Designs that utilize a predetermined amount of tension to secure the mask risk being either uncomfortably tight or so loose that an effective seal is not obtained. It is important to note that an uncomfortable mask will likely be worn less than a comfortable mask. Tight-fitting masks may cause tissue soreness, claustrophobia, headaches and other ailments. A user suffering from these discomforts will not only become distracted from the tasks at hand, but will be more likely to remove the mask before it is safe to do so. Therefore, the comfort provided by the mouthpiece respirator has a direct and beneficial effect on the overall safety of the wearer and the ability of the wearer to maintain that safety level for extended periods of time. Nevertheless, a number of problems remain with current mouthpiece technology.

A significant problem with current mouthpiece designs is achieving and maintaining nasal occlusion. Protective hoods that utilize mouthpiece respirators will not function properly unless the nose is occluded. The wearer must not breath through his nose. Nasal inhalation effectively bypasses the purification systems connected to the mouthpiece respirator, which greatly diminishes the protection factor of the protective hood. In addition, continued nasal inhalation produces a vacuum within the hood enclosure. This vacuum may lead to the introduction of outside, contaminated air into the enclosure.

Without nasal occlusion, nasal exhalation bypasses the mouthpiece respirator. This may lead to the accumulation of moisture and carbon dioxide-rich air within the ocular region of the hood. The cumulative effect of this process may fog the hood's visor and cause the hood to become uncomfortably hot.

In order to achieve nasal occlusion, prior art protective hoods generally utilize a noseclip comprising two opposing nostril pads biased towards each other. The wearer places the noseclip over his nose which is then pinched off. Additionally, outward extending fingers may extend from each nostril pad permitting the wearer to engage or disengage the noseclip from his nose.

When utilizing a noseclip with current protective hoods, the noseclip must be engaged before the protective hood is donned. Once the noseclip is in place, the wearer may then don the protective hood over his head. However, once the protective hood is placed over the wearer's head, the noseclip may no longer be adjusted, repositioned, or put back on if it falls off without removing the hood or otherwise breaking the substantially airtight seal. This is a potentially dangerous situation for the wearer. If the wearer wishes to fix the noseclip to properly occlude the nose, he must break the airtight seal of the protective hood thereby exposing himself to hazardous conditions.

U.S. Pat. No. 5,186,165 to Swann describes a deployable hood and mouthpiece which utilize a flexible, substantially transparent hood in place of a visor. As the Swann patent utilizes a mouthpiece respirator, the requisite noseclip is also described and illustrated. While the flexible, substantially transparent hood in the Swann patent might permit limited external articulation of the noseclip; it does not provide a universal fit to an adult population. The noseclip in the Swann patent is pivotally secured to the mouthpiece (column 8, line 22). Accordingly, no adjustment means are taught or provided by the Swann patent. The flexible properties of the substantially transparent material in the Swann patent that permit limited external actuation of the noseclip also distort outward vision. There are no external grasping means for articulating the Swann noseclip. This would make external actuation a difficult and blind operation with no clear or obvious means of control, particularly in an emergency situation. Furthermore, materials and sealing mechanisms of the Swann patent do not provide for a substantially airtight seal required for chemical, biological and nuclear agent protection (column 9, lines 4–5). Consequently, what is needed is a means to externally actuate an integrated nose clip while providing a universal fit, clear outward vision, a substantially airtight seal, ease of use and little to no training to achieve proficiency.

With prolonged use, the wearer may wish to temporarily disengage or re-adjust the noseclip for comfort. Again, he must break the substantially airtight seal and expose himself to hazardous conditions to make the adjustments in the noseclip.

Another problem in the prior art involves the speed of donning the protective hood and establishing a secure respiratory pathway. With current designs, the wearer must first engage the noseclip before donning the protective hood. The action of putting on the noseclip is a critical element of use that requires proper training and practice. Furthermore, the step of engaging the noseclip must be done while the user is unprotected from hazardous conditions. It would be advantageous for the user to immediately don the protective hood and benefit from the hood's protection factor as soon as possible.

Still another problem in the prior art is that of multiple and separate parts. As the noseclip is separate from the protective hood there is a risk that the noseclip might be lost. As described above, the noseclip is a critical part to the proper use of a mouthpiece respirator. While noseclips have been tethered to protective hoods, they may still come apart from the attachment. It would be desirable to integrate the noseclip into the hood so that the possibility of losing a critical part is eliminated.

U.S. Pat. No. 1,978,994 to Fortunato (the '994 patent) describes a respiratory protective helmet having a forwardly extending cup-shaped nose piece enclosing a wire noseclip actuated externally to hold the nose closed and permit breathing only through the mouth. While nasal occlusion is externally actuated in the Fortunato patent, a number of drawbacks remain.

The nosepiece enclosure of the Fortunato patent significantly obstructs the view of the wearer. Maintaining clear outward vision is a highly desirable feature in respiratory protective hoods that often find use in military, law enforcement, and escape and rescue operations.

Another drawback with the Fortunato patent is that it does not accommodate facial variations between different users. There are no provisions for the wire noseclip to move laterally or longitudinally for a proper fit. If the noseclip is not positioned correctly to occlude the nose, the protection factor of the apparatus is significantly compromised.

Another drawback with the apparatus described in the Fortunato patent is that it does not pack into a compact size. Fortunato describes a helmet "preferably made from stiff rubber" (column 1, lines 42–43) and a "forwardly extending cup-shaped nose piece." (Column 2, lines 74–75). The ability of a respiratory protective device to fold into a compact design provides a number of important benefits including high portability and low storage requirements.

Consequently, there is a need in the art for an externally adjustable, integrated noseclip adapted for use with a respiratory protective hood that permits the user to immediately don the protective hood without requiring the user to first don and engage the nose clip.

There is a further need in the art for an externally adjustable, integrated noseclip that permits wearer to disengage and re-engage the noseclip without removing the protective hood or otherwise breaking the substantially airtight seal.

There is a further need in the art for an integrated noseclip that provides substantially unobstructed outward vision for the wearer.

There is a further need in the art for an integrated noseclip that can move in multiple directions to accommodate a wide variety of nose sizes, nose shapes and facial configurations.

There is a further need in the art for an integrated noseclip that can fold with a respiratory protective hood into a compact size for optimum storage and portability.

There is a further need in the art to reduce the number of separate parts needed to properly use a respiratory protective hood.

However, in view of the prior art at the time the present invention was made, it was not obvious to those of ordinary skill in the pertinent art how the identified needs could be fulfilled.

SUMMARY OF THE INVENTION

Generally described, the present invention provides a respiratory protective hood having an integrated, externally adjustable noseclip comprising an air-impermeable hood adapted to enclose the head of a wearer having a nasal region, an ocular region and an oral region. The nasal region is the area in front of the wearer's nose. The ocular region is the area in front of the wearer's eyes. The oral region is the area in front of the wearer's mouth. A substantially transparent visor sealingly integrated into the ocular region of the air-impermeable hood permits the wearer to see outside the air-impermeable hood. It is preferred that the visor be constructed of chemically resistant, flexible material that maintains its transparency even after repeated folding.

A pivotally adjustable, retractable, and extendable noseclip adapted to compress a wearer's nostrils together thereby substantially inhibiting nasal respiration is provided. This ensures that air breathed in and out is channeled through a filtration system. The filtration system is connected to a mouthpiece engaged by the wearer. In order to engage and disengage the noseclip from the wearer's nostrils, an actuator means is provided. The actuator means may comprise two outwardly extending finger provisions that may be pressed together to open the noseclip and released to close the noseclip. Nose pads are secured distal to the actuator means and are dimensioned to fit on each side of the wearer's nose.

A nasal access passage cut from the air-impermeable hood in the nasal region provides an opening to place the noseclip so that it may reach the nose of the wearer on the inside of the hood yet may be actuated externally. To maintain the air-impermeability of the protective hood, an elastomeric air-impermeable boot is securely fitted to the actuator means and air-impermeably sealed to the perimeter of the nasal access passage. The wearer externally controls the noseclip through the elastomeric air-impermeable boot.

Because the boot is flexible, a wide range of movement is possible for the noseclip while still maintaining nasal occlusion. The noseclip may move inward towards the wearer's face to accommodate facial variations wherein the nose is located further from the substantially transparent visor. Permitting the noseclip to travel inward also permits the wearer to release a mouthpiece respirator from his mouth so he can talk. Alternatively, the noseclip may travel outwards, away from the wearer's face to accommodate a different facial variation having the nose located relatively near the front of the hood.

The noseclip may tilt downwards if the wearer's nose is positioned lower in the hood or the wearer looks down. The noseclip may tilt upwards if the wearer's nose is positioned higher in the hood or the wearer looks up. The noseclip may move side to side on a horizontal plane to maintain nasal occlusion when the wearer turns his head left and right.

In a preferred embodiment, the substantially transparent visor extends from the ocular region to the nasal region. Accordingly, the nasal access passage is cut from the substantially transparent visor. This permits a wide field of vision without significant obstructions. In order to gain an even wider field of vision, clamping rings may be utilized instead of tape to seal the elastomeric air-impermeable boot to the nasal access passage. Clamping rings provide a resilient air-impermeable barrier with smaller physical dimensions than those required by tape.

An inner clamping ring adapted to seal the nasal access passage from the inside of said air-impermeable hood opposes an outer clamping ring adapted to seal the nasal access passage from the outside of the air-impermeable hood. A boot flange extending from the perimeter of the elastomeric air-impermeable boot overlaps an exterior perimeter shoulder of the nasal access passage. The boot flange and the exterior perimeter shoulder of the nasal access passage are sandwiched between the inner clamping ring and the outer clamping ring.

Alternatively, the boot flange may overlap an interior perimeter shoulder of the nasal access passage and the boot flange and the interior perimeter shoulder of the nasal access passage are sandwiched between the inner clamping ring and the outer clamping ring. Regardless of whether the elastomeric air-impermeable boot is sandwiched on the interior or exterior of the hood, it is preferred that the inner clamping ring and the outer clamping ring be ultrasonically welded together.

In a preferred embodiment, a L-shaped nose bracket positioned directly below the substantially transparent visor is adapted to project the substantially transparent visor away from the nasal region. The nose bracket may be secured to the mouthpiece respirator in the interior of the hood. By keeping the substantially transparent visor away from the nasal region, the wearer enjoys a higher comfort level, as the wearer's nose does not come into contact with the substantially transparent visor. Additionally, because the nose bracket is only secured to the mouthpiece respirator, the protective hood maintains a high level of flexibility and the ability to collapse into a small size for portability and storage.

To give the elastomeric, air-impermeable boot substantial travel, it is preferred that it contains at least one or more flexible bellows. To enhance the elastomeric, air-impermeable boot's effectiveness against hazardous substances, butyl rubber is the preferred construction material. However, neoprene or any other flexible, air-impermeable material may also be used.

An object of this invention is to provide a noseclip for a mouthpiece respirator integrated into a vapor tight protective hood.

Another object of this invention is to integrate the noseclip in a protective hood while providing substantially unobstructed outward vision.

Another object of this invention is to provide an integrated noseclip that can pivot up and down and in and out for proper placement on the wearer's nostrils.

Another object of this invention is to provide an integrated noseclip that maintains a protective hood's ability to collapse to a minimum size for storage and portability.

An advantage of the invention is that the user may immediately don the protective hood and occlude the nose without breaking the substantially airtight seal.

Another advantage of the invention is that the wearer may disengage and re-engage the noseclip without breaking the substantially airtight seal.

Another advantage of the invention is that the wearer enjoys substantially unobstructed outward vision.

Another advantage of the invention is that the integrated noseclip may accommodate a wide variety of nose sizes, shapes and locations.

Another advantage of the invention is that the noseclip design permits the respiratory protective hood to pack into a small size for optimum storage and portability.

Another advantage of the invention is that the noseclip is no longer a separate part from the respiratory protective hood. Therefore, the risk of losing a critical part is eliminated.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
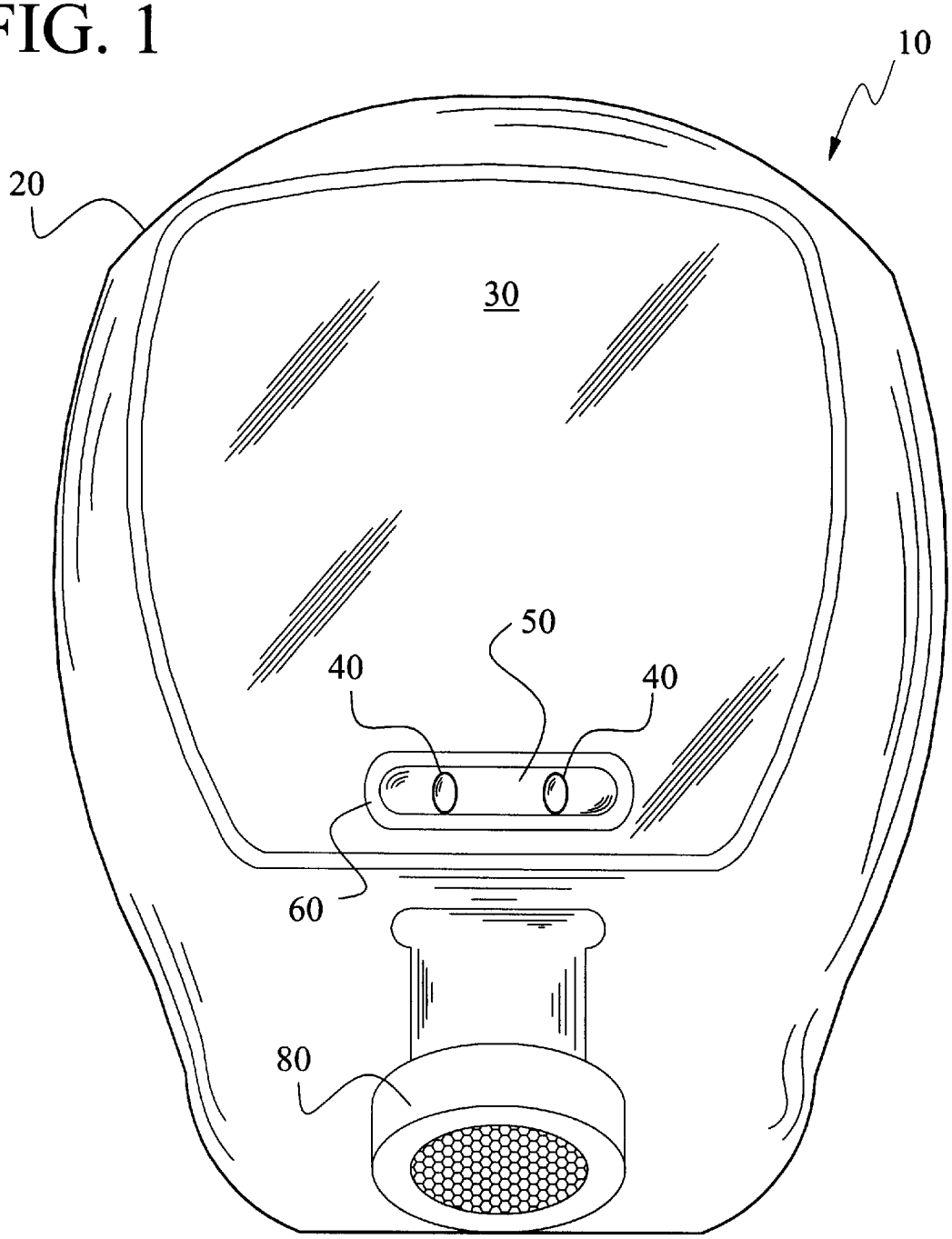
FIG. 1 is a front elevated view of a mouthpiece respiratory protective hood according to the invention.
Figure 2:
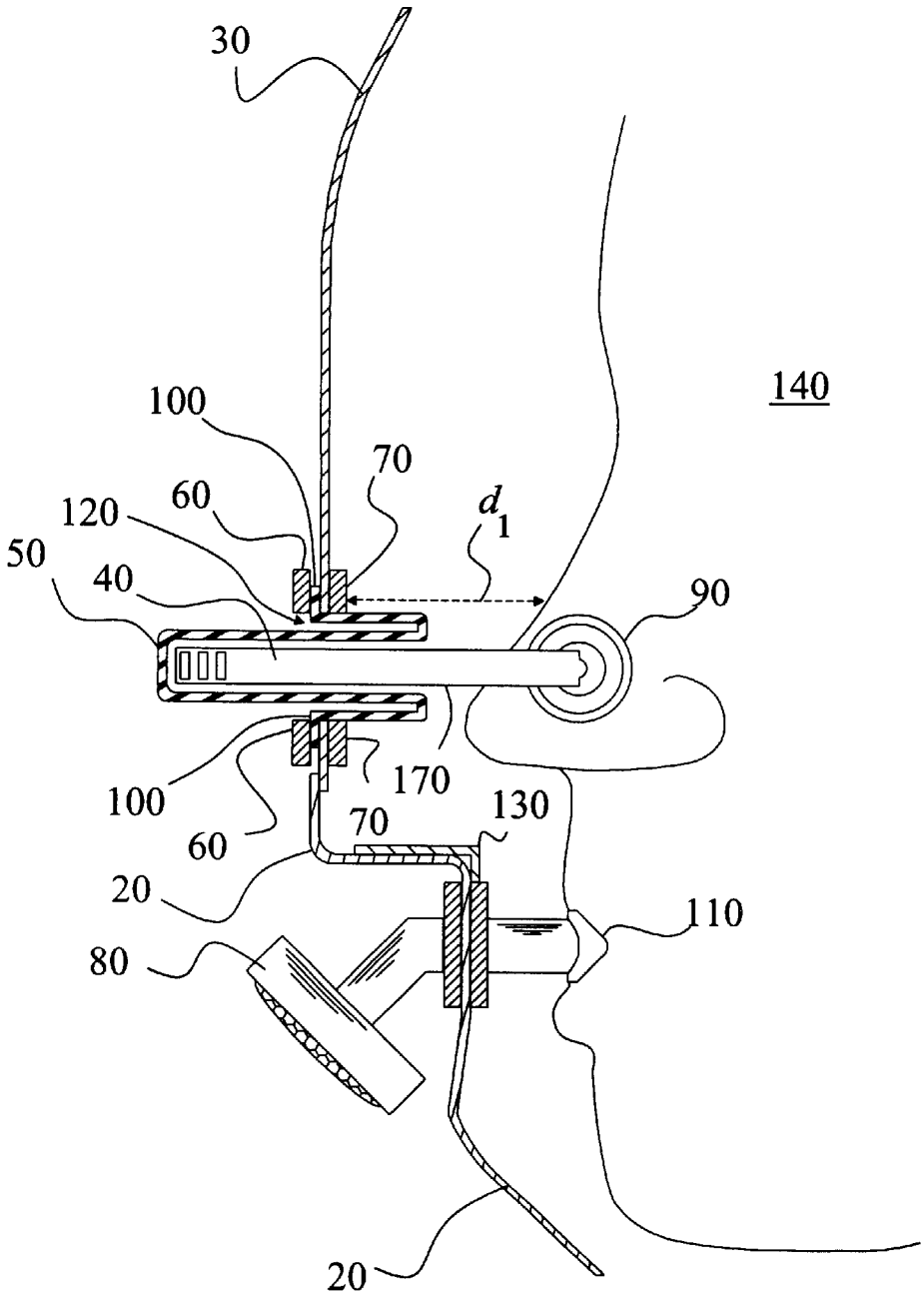
FIG. 2 is a side cross-sectional view of the externally actuated, integrated noseclip according to the invention.

Referring initially to FIG. 1 and FIG. 2, it will there be seen that an illustrative embodiment of the present invention is denoted by the reference number 10 as a whole. An air-impermeable hood 20 is adapted to enclose the head of a first wearer 140. In this preferred embodiment, a substantially transparent visor 30 is sealingly integrated into said air-impermeable hood 20 over the ocular region and nasal region of said first wearer 140. A filtration system 80 is located on the exterior of said air-impermeable hood 20 and is adapted to purify air inhaled by said first wearer 140. A noseclip 170 adapted to compress the nostrils of said first wearer 140 together thereby substantially inhibiting nasal respiration. This ensures that air breathed in and out is channeled through said filtration system 80 connected to a mouthpiece 110 engaged by said first wearer 140.

In order to engage and disengage said noseclip 170 from the nostrils of said first wearer 140, an actuator means is provided Said actuator means comprises two outwardly extending finger protrusions 40 that may be pressed together to open said noseclip 170 and released to close the noseclip 170. Nose pads 90 are secured distal to said actuator means and are dimensioned to fit on each side of the nose of said first wearer 140.

A nasal access passage 120 cut from said substantially transparent visor 30 in the nasal region provides an opening to place said noseclip 170 so that it may reach the nose of said first wearer 140 on the inside of said air-impermeable hood 20 yet may be actuated externally. To maintain air-impermeability, an elastomeric air-impermeable boot 50 is securely fitted to said outwardly extending finger protrusions 40 and air-impermeably sealed to the perimeter of said nasal access passage 120. Said first wearer externally controls said noseclip 170 through said elastomeric air-impermeable boot 50.

Because said elastomeric air-impermeable boot 50 is flexible, a wide range of movement is possible for said noseclip 170 while still maintaining nasal occlusion.

In order to maintain a wide field of outward vision, an inner clamping ring 70 adapted to seal said nasal access passage 120 from the inside of said air-impermeable hood 20 opposes an outer clamping ring 60 adapted to seal said nasal access passage 120 from the outside of said air-impermeable hood 20. A boot flange 100 extending from the perimeter of said elastomeric air-impermeable boot 50 overlaps an exterior perimeter shoulder of said nasal access passage 120. Said boot flange 100 and said exterior perimeter shoulder of said nasal access passage 120 are sandwiched between said inner clamping ring 70 and said outer clamping ring 60. It is preferred that said inner clamping ring 70 and said outer clamping ring 60 be ultrasonically welded together.

In a preferred embodiment, a L-shaped nose bracket 130 positioned directly below said substantially transparent visor 30 is adapted to project said substantially transparent visor 30 away from said nasal region. Said nose bracket 130 may be secured to said mouthpiece respirator 110 in the interior of said air-impermeable hood 20. By keeping said substantially transparent visor 30 away from said nasal region, said first wearer 140 enjoys a higher comfort level as the nose of said first wearer 140 does not come into contact with said substantially transparent visor 30. Additionally, because said nose bracket 130 is only secured to said mouthpiece respirator 110, said protective hood 20 maintains a high level of flexibility and the ability to compact into a small size for portability and storage.

Figure 3:
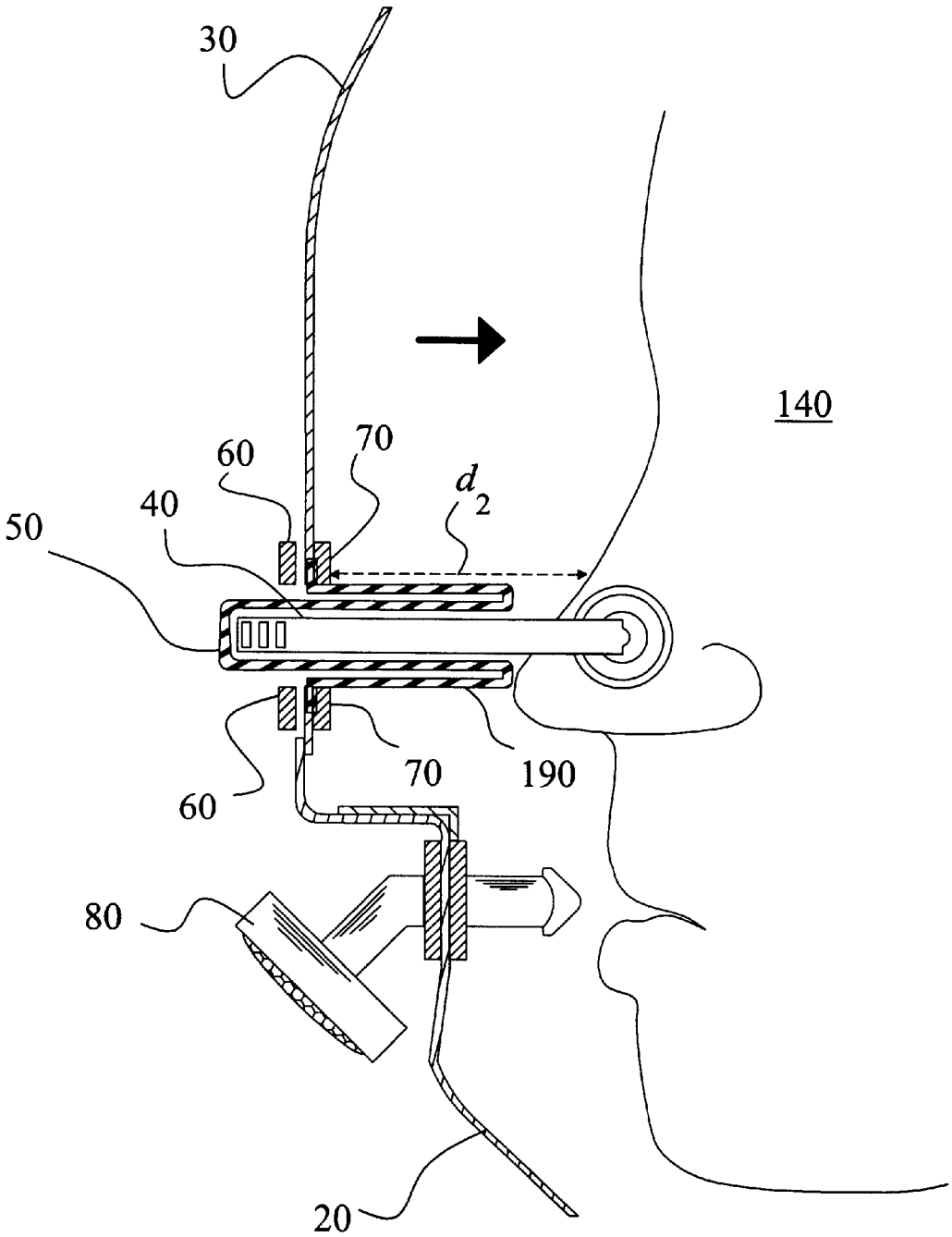
FIG. 3 is a side cross-sectional view of the externally actuated, integrated noseclip according to the invention with the noseclip inwardly protruding yet still engaged to the wearer's nose even though the wearer has disengaged the mouthpiece respirator.

It is important to note the ability of the design to provide a substantially universal fit. As illustrated in FIG. 2, a first distance $d_1$ represents the distance between said substantially transparent visor 30 and a point on the nose of said first wearer 140. In FIG.3, said first wearer 140 has disengaged said mouthpiece respirator causing the face to move away from said substantially transparent visor 30. A second distance $d_2$ represents the greater distance between said substantially transparent visor 30 and said point on the nose of said first wearer 140. However, said noseclip 170 remains engaged as a flexible bellows 190 in said elastomeric air-impermeable boot 50 accommodates the change in nose position while maintaining an airtight seal.

Figure 4:
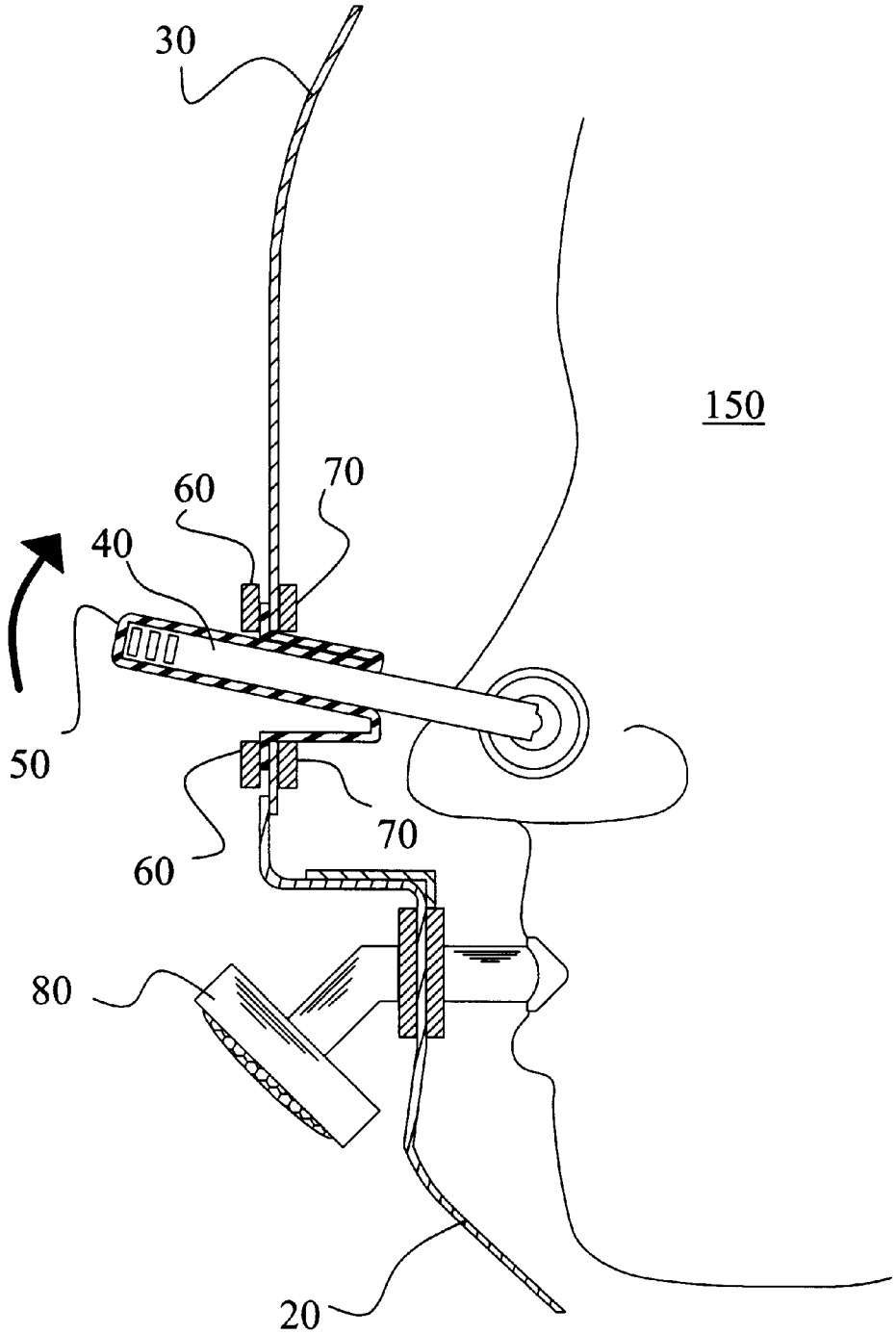
FIG. 4 is a side cross-sectional view of the externally actuated, integrated noseclip according to the invention with the noseclip downwardly angled to occlude a second wearer's nose located relatively lower in the hood.

In FIG. 4, a second wearer 150 is shown having a lower nose position than said first wearer 140. However, said noseclip 170 remains engaged as said elastomeric air-impermeable boot 50 accommodates the change in nose position by tilting downward.

Figure 5:
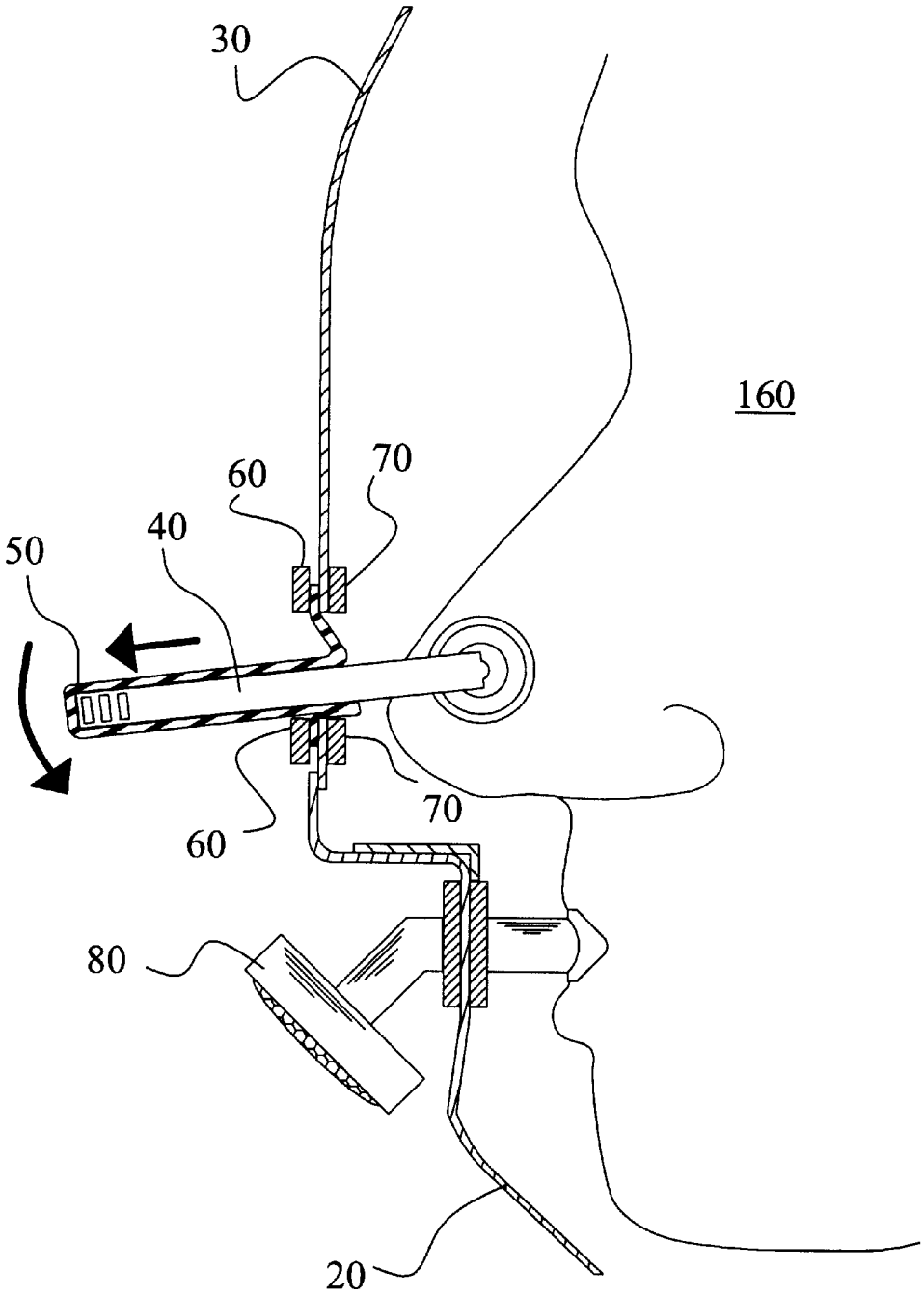
FIG. 5 is a side cross-sectional view of the externally actuated, integrated noseclip according to the invention with the noseclip upwardly angled and outwardly protruding to occlude a third wearer's nose located relatively higher in the hood and relatively closer to the substantially transparent visor.

In FIG. 5, a third wearer 160 is shown having a larger nose which is positioned closer to said substantially transparent visor 30 than said first wearer 140 and said second wearer. However, said noseclip 170 remains engaged as said elastomeric air-impermeable boot 50 accommodated the change in nose position by tilting upward and also partially withdrawing from said air-impermeable hood 20.

Figure 6:
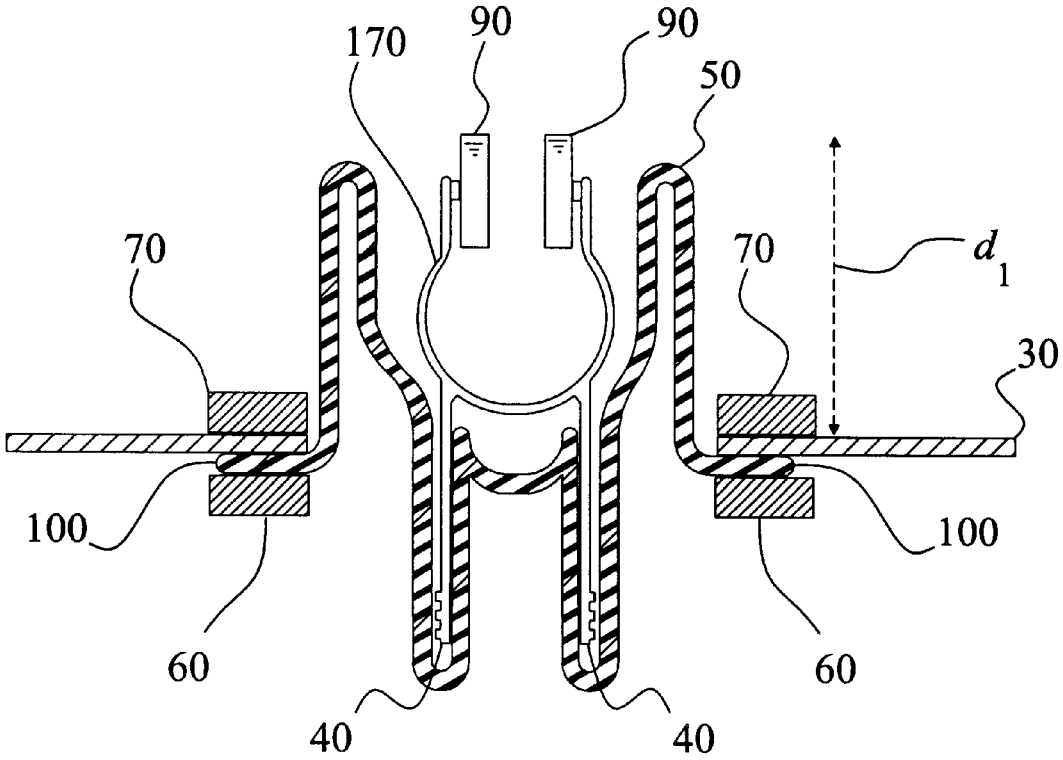
FIG. 6 is an overhead cross-sectional view of the externally actuated, integrated noseclip according to the invention.
Figure 7:
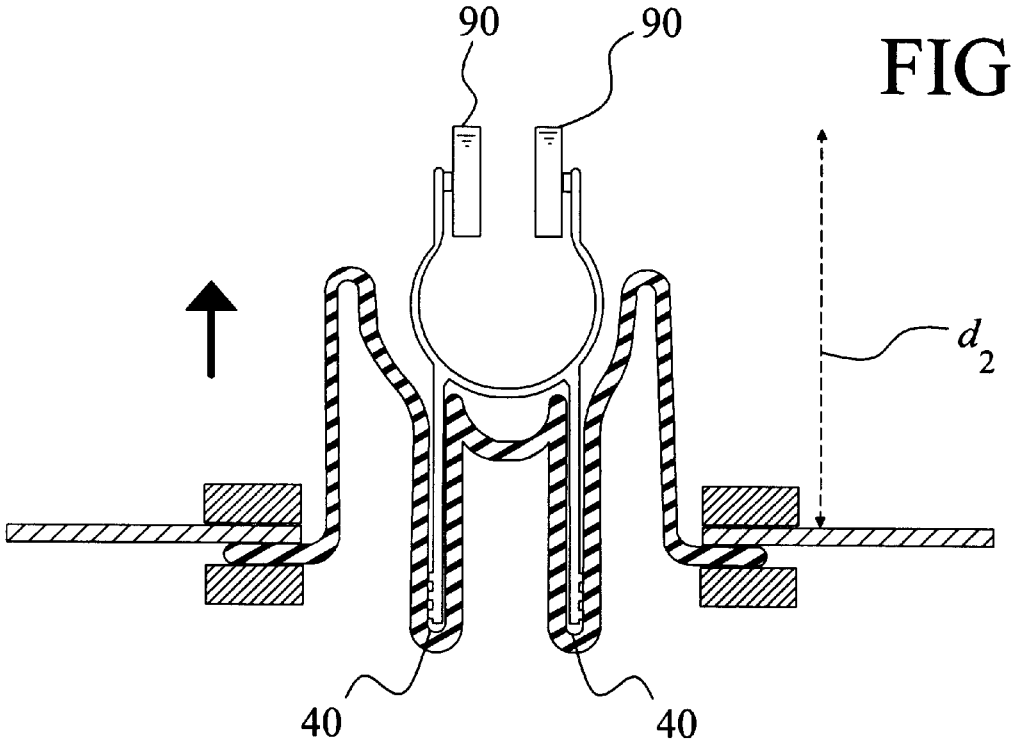
FIG. 7 is an overhead cross-sectional view of the externally actuated, integrated noseclip according to the invention with the noseclip inwardly protruding.
Figure 8:
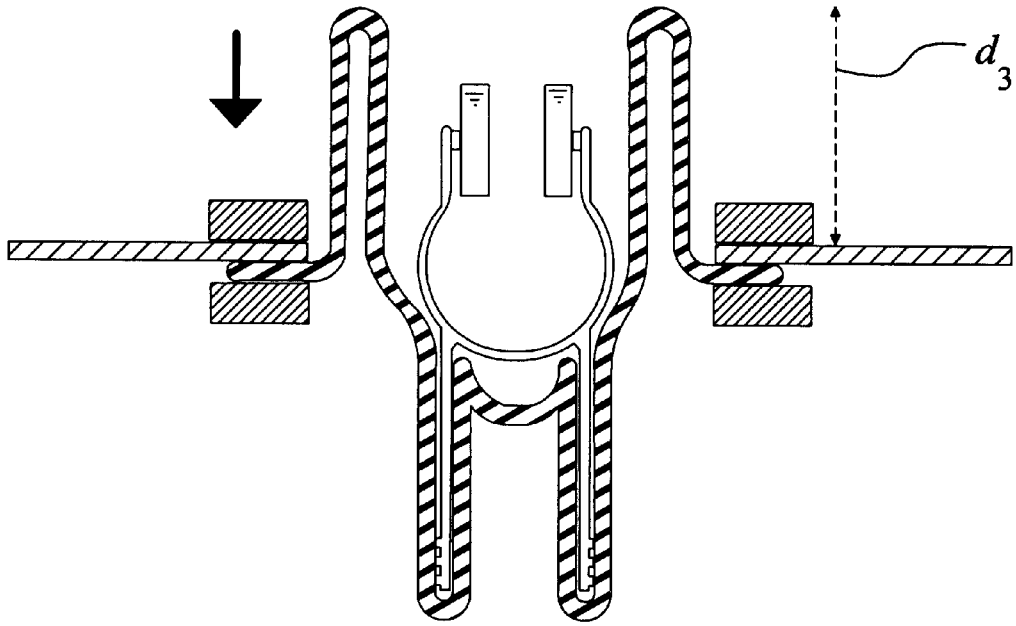
FIG. 8 is an overhead cross-sectional view of the externally actuated, integrated noseclip according to the invention with the noseclip outwardly withdrawn.

FIG. 6 illustrates a top view of the invention showing said nose pads 90 opposing each other. Said two outwardly extending finger protrusions 40 from said noseclip 170 are enclosed by said elastomeric air-impermeable boot 50. Again, said first distance $d_1$ represents the distance between said substantially transparent visor 30 and a point on the nose of said first wearer 140. FIG. 7 illustrates a top view of an inward extension of said noseclip 170 into said air-impermeable hood 20. Said second distance $d_2$ represents the greater distance away from said substantially transparent visor 30 while still properly positioning said nose pads to provide nasal occlusion. FIG. 8 illustrates a top view of an outward extension of said noseclip 170 from said air-impermeable hood 20. A third distance $d_3$ represents a lesser distance from said substantially transparent visor 30 while properly positioning said nose pads to provide nose occlusion.

Figure 9:
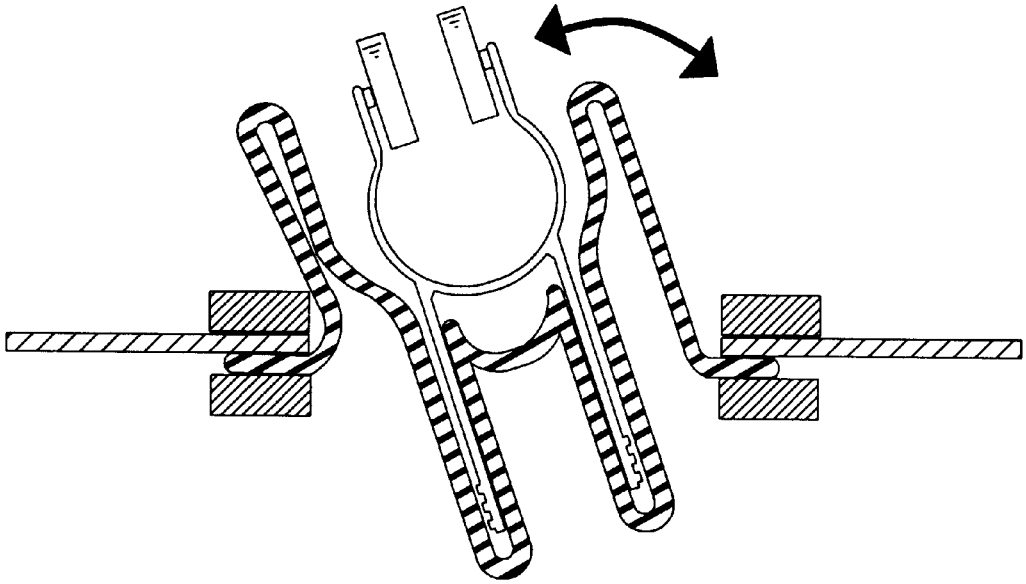
FIG. 9 is an overhead cross-sectional view of the externally actuated, integrated noseclip according to the invention with the noseclip rotated counterclockwise on a horizontal plane.

FIG. 9 illustrates a top view of the invention's ability to rotate side to side on a horizontal plane to maintain nose occlusion when turning the head left or right.

Figure 10:
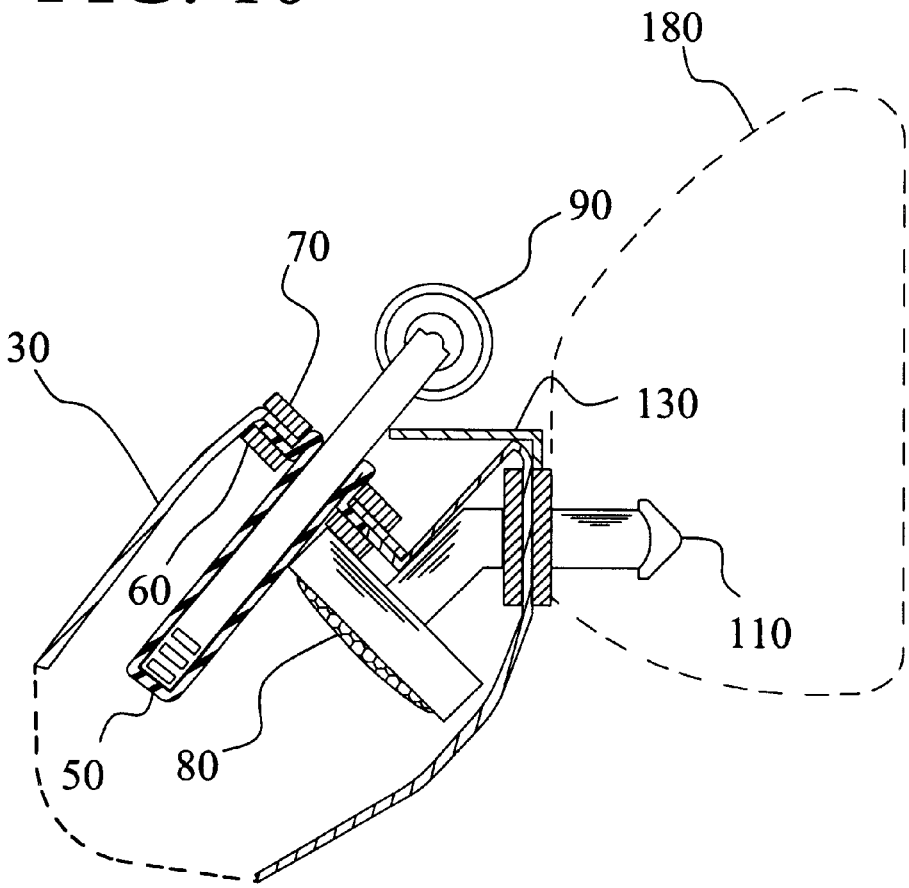
FIG. 10 is an side cross-sectional view of the externally actuated, integrated noseclip according to the invention folded for storage and a comparative profile of a half-mask nose cup.

In FIG. 10, the entire respiratory protective hood 10 is folded into a compact size. For comparison, a half-mask profile 180 is provided to illustrate the detrimental increase in size for even a half-mask's nose cup structure.

Figure 11:
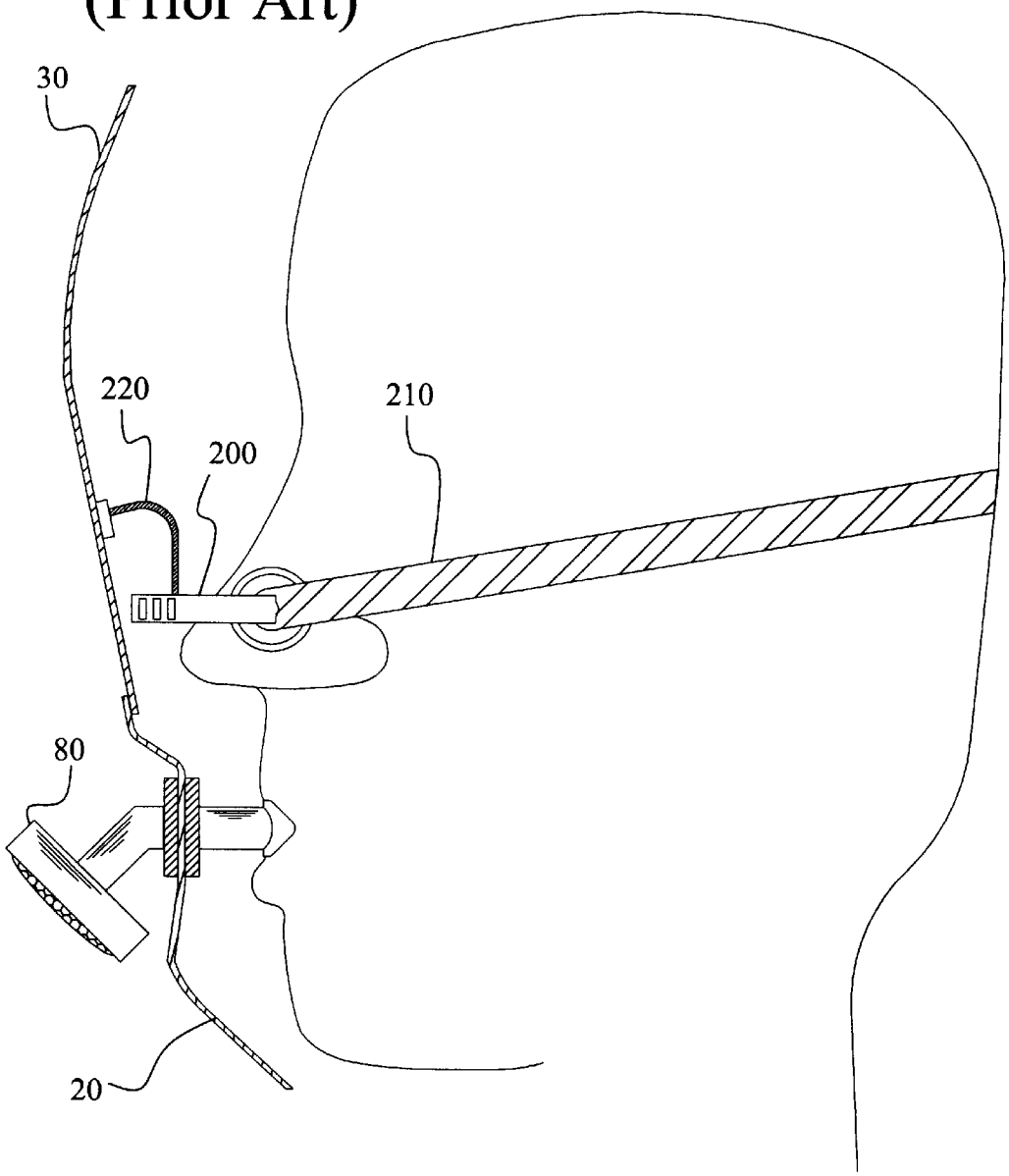
Fig. 11 (Prior Art)
FIG. 11 is a side cross-sectional view of a prior art mouthpiece respiratory protective hood having a non-integrated, non-eternally actuated noseclip design.

FIG. 11 shows an illustrative example of the prior art having a non-integrated, non-externally actuated nose-clip200 attached to a the visor 30 by a tether means 220. Alternatively, an elastic band 210 may be used to hold the noseclip in place. In this prior art design, the wearer has limited ability to externally adjust the noseclip. Consequently, should the wearer need to engage, disengage, or adjust the noseclip, the substantially airtight seal must be broken.

It will be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described.

What is claimed is:

1. A respiratory protective hood having an integrated, eternally adjustable noseclip, comprising:

an air-impermeable hood adapted to enclose the head of a wearer, said hood having a nasal region, an ocular region and an oral region;

a substantially transparent visor sealing integrated into said ocular region of said air-impermeable hood and adapted to enable outward vision by said wearer;

a pivotally adjustable noseclip adapted to compress a wearer's nostrils together to substantially inhibit nasal respiration;

an actuator means formed integrally with said noseclip for engaging and disengaging said noseclip from said wearer's nostril's;

a nasal access passage cut from said air-impermeable hood in said nasal region;

an elastomeric air-impermeable boot having a rim sealingly mounted about a periphery of said nasal access passage;

said boot having a central part disposed in overlying relation to said actuator means so that said actuator means is not exposed to an environment external to said protective hood;

said boot having an intermediate part between said rim and said central part that folds into an interior of said protective hood when said actuator means is retracted to engage a nose positioned remote from said nasal access passage and that unfolds at least partially when said actuator means is extended to accommodate a nose positioned in close proximity to said nasal access passage;

whereby said wearer engages and disengages said nose-clip by manipulation of said actuator means; and whereby said boot enables said noseclip to be retracted and extended relative to said nasal access passage.

2. The respiratory protective hood of claim 1 wherein said pivotally adjustable noseclip is tiltable on a vertical axis.

3. The respiratory protective hood of claim 1 wherein said pivotally adjustable noseclip is rotatable about a horizontal axis.

4. The respiratory protective hood of claim 1, further comprising:

an inner clamping ring mounted about a periphery of said nasal access passage on an internal side thereof, said inner clamping ring being adapted to seal said nasal access passage from the inside of said air-impermeable hood;

(b) an outer clamping ring mounted about said periphery of said nasal access passage on an external side thereof, said outer clamping ring being adapted to seal said nasal access passage from the outside of said air-impermeable hood;

(c) said rim of said boot being sandwiched between said outer clamping ring and an external wall of said hood.

5. The respiratory protective hood of claim 4 wherein said inner clamping ring and said outer clamping ring we are ultrasonically welded together.

6. The respiratory protective hood of claim 1, further comprising:

(a) an inner clamping ring mounted about a periphery of said nasal access passage on an internal side thereof, said inner clamping ring being adapted to seal said nasal access passage from the inside of said air-impermeable hood;

(b) an outer clamping ring mounted about said periphery of said nasal access passage on an external side thereof, said outer clamping ring being adapted to seal said nasal access passage from the outside of said air-impermeable hood;

(c) said rim of said boot being sandwiched between said inner clamping ring and an internal wall of said hood.

7. The respiratory protective hood of claim 1 wherein said nasal access passage is a cut-out formed in said substantially transparent visor.

8. The respiratory protective hood of claim 1, further comprising a nose bracket positioned below said substantially transparent visor, said nose bracket adapted to project said substantially transparent visor away from said nasal region.

9. The respiratory protective hood of claim 1 wherein said elastomeric air-impermeable boot is formed of butyl rubber.

10. A respiratory protective hood having an integrated, externally adjustable nose clip comprising:

(a) an air-impermeable hood adapted to enclose the head of a wearer, said hood having a nasal region, an ocular region and an oral region;

(b) a substantially transparent visor overlying said ocular region and said nasal region and sealingly integrated into said air-impermeable blood and adapted to enable outward vision by said wearer;

(c) a pivotally adjustable nose clip adapted to compress a wearer's nostrils together thereby substantially inhibiting nasal respiration, said pivotally adjustable nose-clip being tiltable on a vertical axis, rotatable about a horizontal axis, extendable away from said nasal region and retractable towards said nasal region;

(d) an actuator means for engaging and disengaging said nose clip from said wearer's nostrils;

(e) a nasal access passage cut from said substantially transparent visor in said nasal region;

(f) an elastomeric air-impermeable boot having a rim sealingly mounted about a periphery of said nasal access passage;

(g) said boot having a central part disposed in overlying relation to said actuator means so that said actuator means is not exposed to an environment external to said protective hood;

(h) said boot having an intermediate part between said rim and said central part that folds into an interior of said protective hood when said actuator means is retracted to engage a wearer's nose positioned remote from said nasal access passage and that unfolds at least partially when said actuator means is extended to accommodate a wearer's nose positioned in close proximity to said nasal access passage;

(i) an inner clamping ring adapted to seal said nasal access passage from the inside of said air-impermeable hood;

(j) an outer clamping ring adapted to seal said nasal access passage from the outside of said air-impermeable hood;

(k) said rim of said boot being sandwiched between said outer clamping ring and and external wall of said hood, whereby said wearer engages and disengages said nose clip by manipulation of said actuator means; and whereby said boot enables said noseclip to be retracted and extended relative to said nasal access passage.

* * * * *